US006449446B2

(12) United States Patent
Kashihara

(10) Patent No.: US 6,449,446 B2
(45) Date of Patent: Sep. 10, 2002

(54) CHARGING DEVICE AND TRANSFER DEVICE

(75) Inventor: Mabumi Kashihara, Niigata (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/772,012

(22) Filed: Jan. 29, 2001

(30) Foreign Application Priority Data

Jan. 28, 2000 (JP) ..... 2000-019851

(51) Int. Cl.[7] ..... G03G 15/00

(52) U.S. Cl. ..... 399/89; 399/50; 399/88; 399/90

(58) Field of Search ..... 399/50, 66, 88, 399/89, 90, 115, 121, 168, 174, 175, 176, 297, 313, 314

(56) References Cited

U.S. PATENT DOCUMENTS 5,287,146 A * 2/1994 Uno et al. ..... 399/89
5,673,107 A * 9/1997 Masuda ..... 399/88
6,190,295 B1 * 2/2001 Kawano et al. ..... 399/176

FOREIGN PATENT DOCUMENTS

JP 6-35302 2/1994

* cited by examiner

*Primary Examiner*—Arthur T. Grimley
*Assistant Examiner*—Hoang Ngo
(74) *Attorney, Agent, or Firm*—Ostrolenk, Faber, Gerb & Soffen, LLP

(57) ABSTRACT

A charging device comprises a conductor, which is in contact with a photoconductor, and a power source circuit, which applies a voltage to the conductor and electrically charges the photoconductor as to have a predetermined level of potential. The power source circuit includes a resistor having a predetermined level of resistance, and provides the conductor with a voltage through the resistor, thereby to stabilize the charged potential of the photoconductor.

3 Claims, 6 Drawing Sheets

CHARGING DEVICE AND TRANSFER DEVICE

BACKGROUND OF THE INVENTION

1. Field of the Invention

The present invention relates to a charging device, and more particularly, to a contact-type charging device employed in an electronic photographic printer. The present invention also relates to a transfer device employed in an electronic photographic printer.

2. Description of the Related Art

An electronic photographic printer comprises a charging device, an exposure device, a developing device, a transfer device, and a fixation device.

Printing of an image onto a recording medium (such as a paper, etc.) is performed using the following procedures:

The charging device electrically charges the surface of a photoconductor to have a predetermined potential. Particularly, the charging device includes a conductive charge roller which is in contact with the surface of the photoconductor. The charging device applies a DC constant voltage to the charge roller, thereby the surface of the photoconductor is charged with a predetermined potential.

The exposure device exposes the photoconductor in a pattern corresponding to a to-be-printed image. In an area of the surface on which a light beam is irradiated, the charges disappear. Thus, an electrostatic latent image of the to-be-printed image is formed on the surface of the photoconductor.

Subsequently, the developing device forms the toner image on the surface of the photoconductor. Particularly, the developing device electrically charges toner as to have a polarity which is opposite to a polarity of the photoconductor, and affixes the toner onto the surface of the photoconductor. Having performed this, the toner image is formed on the surface of the photoconductor.

After this, the transfer device transfers the toner image formed on the surface of the photoconductor onto a recording medium. Particularly, the transfer device includes a conductive transfer roller. A recording medium is sandwiched between the transfer roller and the photoconductor. The transfer device applies a DC constant voltage to the transfer roller, so as to attract the toner image onto the recording medium. Hence, the toner image is transferred from the photoconductor onto the recording medium.

Finally, the fixation device fixes the toner image on the recording medium, thus completing the printing of the image on the recording medium.

The current flowing to the charge roller varies, depending on the temperature, the humidity, and the abrasion of the photoconductor. Thus, if the voltage to be applied to the charge roller is constant, the charged potential of the photoconductor also varies in accordance with the temperature, the humidity and the abrasion of the photoconductor. Such variation in the potential causes deterioration in the printing.

Particularly, if the photoconductor is not sufficiently charged, the toner is not affixed onto the surface of the photoconductor. This results in creating an unclear printing image. On the contrary, if the photoconductor is excessively charged, a large amount of toner is affixed thereonto. This results in making a large mess on the recording medium.

In order to overcome the above problems, according to the technique disclosed in Unexamined Japanese Patent Application KOKAI Publication No. H6-35302, a current flowing to a charge roller is measured, and a DC voltage to be applied to the charge roller is controlled in accordance with the result of the measurement.

In the technique of Unexamined Japanese Patent Application KOKAI Publication No. H6-35302, it is necessary to prepare a current measurement circuit, which measures the current flowing to the charge roller, and a controller, which controls the voltage in accordance with the measured result. Hence, the electronic photographic printer is manufactured at a high cost.

Likewise the above, the current flowing to the transfer roller also varies based on the temperature, the humidity, etc. Thus, if the voltage to be applied to the transfer roller is constant, the charged potential of the transfer roller is not stable. Therefore, the toner image on the photoconductor may not completely be transferred onto the recording medium.

When the current flowing to the transfer roller increases, unless the voltage to be applied to the transfer roller decreases, a leakage current may occur. In this structure, the toner image on the photoconductor can not be transferred, or the toner may be scattered around. When the current flowing to the transfer roller decreases, unless the voltage to be applied to the transfer roller increases, the adequate potential for transferring the toner image can not be obtained. Hence, the deterioration of the printing quality occurs.

In the technique of Unexamined Japanese Patent Application KOKAI Publication No. H6-35302, the above-described problems have not been mentioned. Thus, the above-described problems can not be overcome, even the technique of the publication is employed.

The entire disclosure of the above publication is incorporated herein by reference.

SUMMARY OF THE INVENTION

It is accordingly an object of the present invention to provide a charging device and a transfer device which can realize high quality printing at a low cost.

In order to achieve above object, according to the first aspect of the present invention, there is provided a charging device comprising:

a conductor which is in contact with a photoconductor; and a power source circuit which applies a voltage to the conductor, thereby to electrically charge the photoconductor as to have a predetermined potential, and wherein the power source circuit includes a resistor having a predetermined level of resistance, and provides the conductor with a voltage through the resistor.

According to this invention, the power source circuit provides the conductor with a voltage through the resistor. Thus, the voltage to be applied to the conductor varies in accordance with the current flowing to the conductor. Particularly, the higher the current flowing to the conductor, the lower the voltage applied to the conductor. On the other hand, the lower the current flowing to the conductor, the higher the voltage applied to the conductor. This can prevent the variation in the charged potential of the photoconductor. In the structure where only the resistor additionally included in the power source circuit, the charged potential of the photoconductor can be stable. Therefore, high quality printing can be realized at a low cost.

The power source circuit may include a rectification circuit which provides a predetermined level of a voltage; and the resistor may be connected in series between the rectification circuit and the conductor.

Resistance of the resistor may be in a range between 1 and 2 mega-ohms, most preferably 1.5 mega-ohms.

In order to achieve the above object, according to the second aspect of the present invention, there is provided a transfer device comprising:

a conductor which faces through a recording medium, a photoconductor on whose surface a toner image is formed; and a power source circuit which applies a voltage to the conductor, thereby to transfer the toner image on the recording medium, and wherein the power source circuit includes a resistor having a predetermined level of resistance, and provides the conductor with a voltage through the resistor.

According to this invention, the power source circuit provides the conductor with a voltage through the resistor. Hence, the voltage to be applied to the conductor varies in accordance with the current flowing to the conductor. Particularly, the higher the current flowing to the conductor, the lower the voltage applied to the conductor. On the other hand, the lower the current flowing to the conductor, the higher the voltage applied to the conductor. This stabilize the potential of the conductor, resulting in providing high quality printing. Only the resistor is additionally included in the power source circuit, realizing such printing at a low price.

The power source circuit may include a rectification circuit which provides a predetermined voltage; and the resistor may be connected in series between the rectification circuit and the conductor.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENT

An electronic photographic printer according to an embodiment of the present invention will now be explained with reference to the accompanying drawings.

Figure 1:
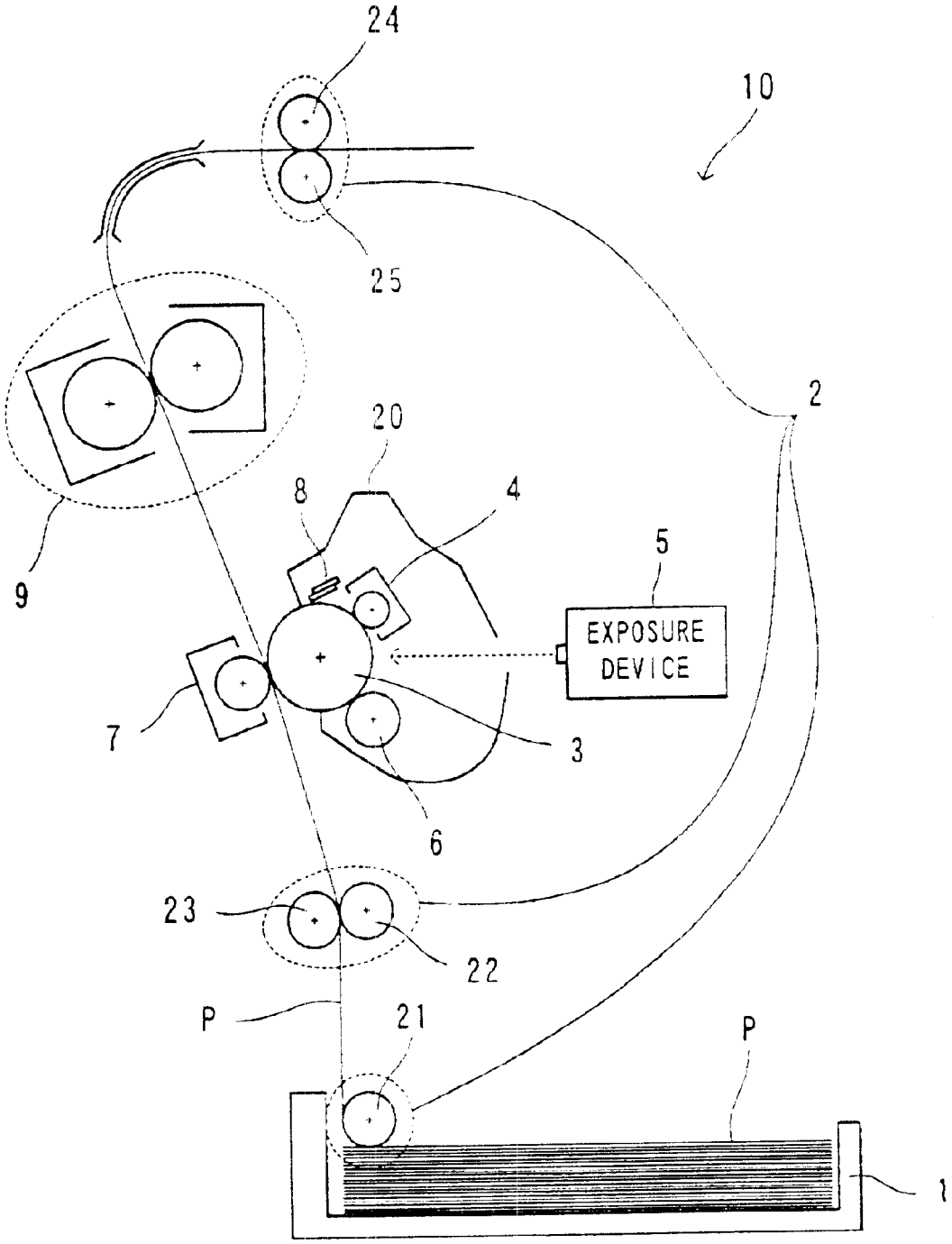
FIG. 1 is a diagram showing the structure of an electronic photographic printer according to all embodiment of the present invention.

An electronic photographic printer 10 according to the embodiment of the present invention comprises, as shown in FIG. 1, a paper feeder hopper 1, a feeder device 2, a photoconductor 3, a charging device 4, an exposure device 5, a developing roller 6, a transfer device 7, a cleaning blade 8, and a fixation device 9.

The photoconductor 3, the charging device 4, the developing roller 6, the cleaning blade 8, and toner (not illustrated) are included in an EP cartridge 20.

The paper feeder hopper 1 stores a paper P as a recording medium.

The feeder device 2 includes feeder rollers 21, 22, 23, 24, 25, etc. The feeder device 2 takes out the paper P from the paper feeder hopper 1, and sends the paper P between the photoconductor 3 and the transfer device 7 and to the fixation device 9, one after another. The feeder device 2 outputs a printed paper P from the electronic photographic printer 10.

The photoconductor 3 comprises a conductive shaft which is formed of aluminum, etc., and an optical conductive layer which is formed around the conductive shaft.

The charging device 4 electrically charges the surface of the photoconductor 3. The structure of the charging device 4 will specifically be described later.

The exposure device 5 irradiates a laser beam onto the photoconductor 3 whose surface is electrically charged. Particularly, the exposure device 5 irradiates a laser beam thereonto, while controlling an ON and OFF status of the laser beam to correspond to the lightness and the darkness of text and image to be printed. If a light beam is irradiated onto the photoconductor 3, charge carriers are generated within the photoconductor 3 so that the charges on the surface of the photoconductor 3 disappear. Thus, by irradiating, onto the photoconductor 3, the laser beam corresponding to the lightness and darkness of the text and image, an electrostatic latent image of the text or image can be formed on the surface of the photoconductor 3.

The developing roller 6 receives a bias voltage, for developing text and image, from a non-illustrative power source circuit. Upon application of this bias voltage, the developing roller 6 electrically charges the toner to have a polarity which is opposite to the polarity of the surface of the photoconductor 3, and affixes the toner onto the surface of the photoconductor 3. Hence, a toner image of the text and image to be printed is formed on the surface of the photoconductor 3. Note that the bias voltage is formed by superimposing a DC voltage of −500[V] and an AC voltage of 1200[V].

The transfer device 7 faces the photoconductor 3. A paper P is provided between the photoconductor 3 and the transfer device 7 by the feeder device 2 one after another. The transfer device 7 transfers the toner image formed on the photoconductor 3 onto the paper P to be provided by the feeder device 2. The structure of the transfer device 7 will specifically be explained later.

The cleaning blade 8 removes the remaining toner from the surface of the photoconductor 3, after the transferring of the toner image is completed.

The fixation device 9 fixes the toner image on the paper P. This completes the printing of the text and image on the paper P.

The structure of the charging device 4 will now specifically be explained.

Figure 2:
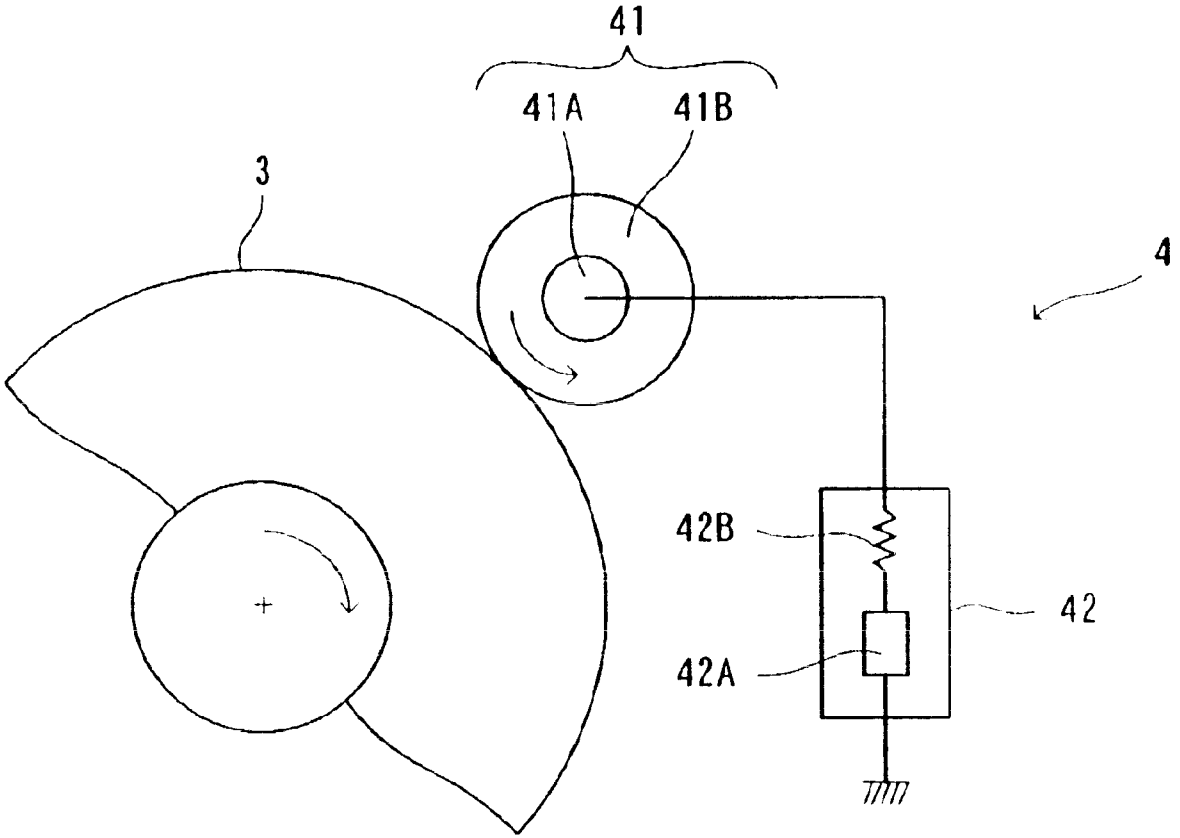
FIG. 2 is a diagram showing the structure of a charging device included in the electronic photographic printer of FIG. 1.

The charging device 4, as shown in FIG. 2, comprises a charge roller 41 and a power source circuit 42.

The charge roller 41 comprises a metal shaft 41A and a conductive layer 41B formed around the metal shaft 41A.

Both ends of the metal shaft 41A are rotatively supported by non-illustrative shaft receivers.

The conductive layer 41B is formed of epichlorohydrine rubber containing an ionic conductive material. The conductive layer 41B has resistance of $10^6$ [Ω], hardness of 56 [degree] as measured according to JIS-A, and surface roughness RMAX in a rotational direction of 15 [μm]. The conductive layer 41B is in contact with the photoconductor 3, so that the charge roller 41 rotates in accordance with the rotation of the photoconductor 3. The entire pressure force of the charge roller 41 is 800 [gf] (7.82 [N]), and the rotational rate of the photoconductor 3 is approximately 121 [mm/sec].

The power source circuit 42 applies a DC voltage to the charge roller 41, thereby to electrically charge the photoconductor 3. The power source circuit 42 comprises a rectification circuit 42A, which has a transformer, a bridge circuit and the like, and a resistor 42B, which is connected in series between the rectification circuit 42A and the charge roller 41. Another structure (such as a radiator, etc.) which is generally incorporated into the power source circuit 42 may be included between the rectification circuit 42A and the resistor 42B, or between the resistor 42B and the charge roller 41.

The power source circuit 42 has the resistor 42B arranged between the rectification circuit 42A and the charge roller 41, as explained above. In this structure, the charged potential of the photoconductor 3 can stably be maintained. This can be shown in the measured results of FIGS. 3 to 5.

Figure 3:
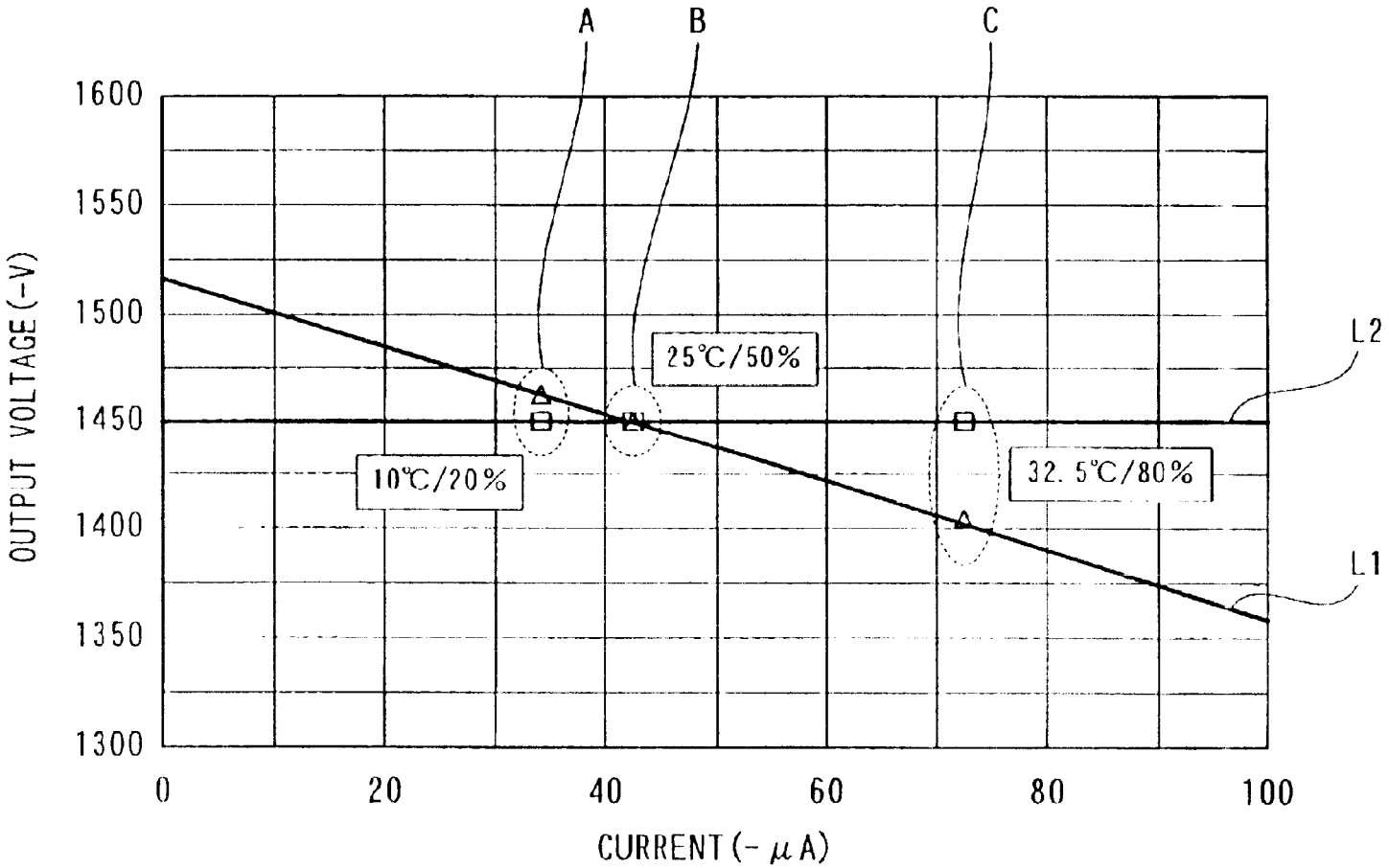
FIG. 3 is a diagram showing the characteristics of voltages which are output to a charge roller by a power source included in the charging device of FIG. 2.

FIG. 3 shows droop characteristics of DC voltages output by the power source circuit 42. FIG. 3 also shows the characteristics of DC voltages output by a conventional power source circuit which does not have the resistor 42B.

In FIG. 3, a reference numeral L1 denotes the characteristics voltages output by the power source circuit 42 (according to this embodiment), and a reference numeral L2 denotes the characteristics of voltages output by the conventional power source circuit (comparison example). Reference symbols A, B, and C denote the results of the measurements performed under the conditions (temperature/humidity) of 10[°C.]/20[%], 25[°C.]/50[%], and 32.5[°C.]/80[%], respectively.

As shown in FIG. 3, the voltage output by the conventional power source circuit remains constant, even if the environment (conditions) surrounding the conventional power source circuit changes. Particularly, the impedance between the charge roller 41 and the photoconductor 3 changes in accordance with the environmental change. Thus, the current flowing to the charge roller 41 changes. However, the voltage output by the conventional power source circuit does not vary, even if the current flowing to the charge roller 41 changes.

The voltage output by the power source circuit 42 of this embodiment varies, in accordance with the environmental change. For example, under the condition of 10[°C.]/20[%], the level of the voltage output by the power source circuit 42 is approximately 1460[V]. Under the condition of 25[°C.] 50[%], the level of the voltage output by the power source circuit 42 is approximately 1450[V] likewise the comparison example. Further, under the condition of 32.5[°C.]/80[%], the level of the voltage is approximately 1400[V]. Accordingly, if the impedance between the charge roller 41 and the photoconductor 3 is decreased, and the current flowing to the charge roller 41 is increased, the voltage output from the power source circuit 42 is decreased. On the contrary, if the impedance between the charge roller 41 and the photoconductor 3 is increased, and the current flowing to the charge roller 41 is decreased, the voltage output from the power source circuit 42 is increased. Such characteristics can be secured in the structure where the resistor 42B is connected in series between the rectification circuit 42A and the charge roller 41.

The degree of slope of the characteristic line L1 may differ depending on the resistance of the resistor 42B. In the structure of the electronic photographic printer 10 shown in FIG. 1, the resistance of the resistor 42B is preferably in a range approximately between 1 to 2 [MΩ]. Shown in FIG. 3 are the characteristics of the voltages output by the power source circuit 42 which includes the resistor 42B having the most-preferable resistance of 1.5[MΩ].

Figure 4:
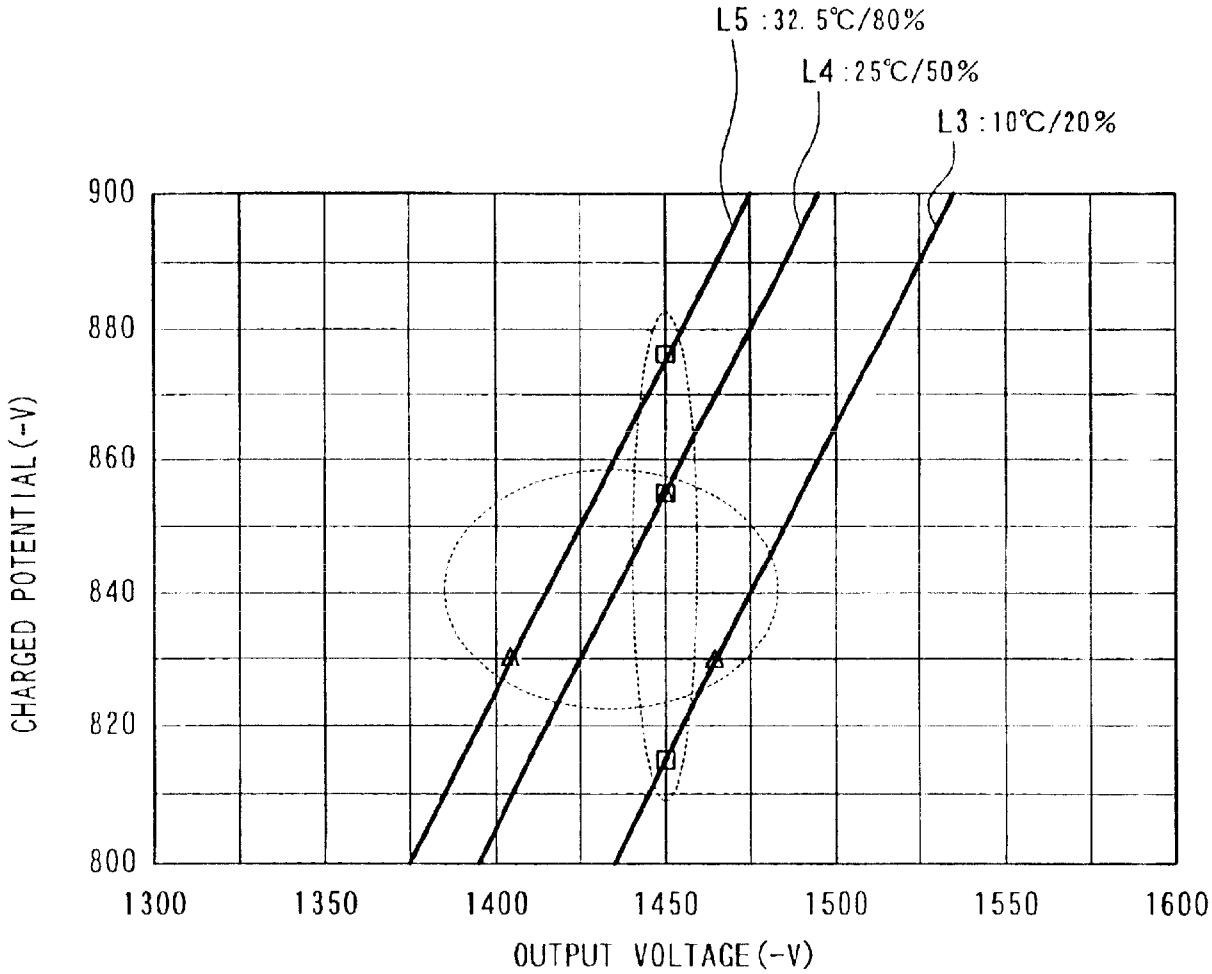
FIG. 4 is a diagram showing the relationship between charged potentials of a photoconductor included in the electronic photographic printer of FIG. 1 and output voltages of the power source.

FIG. 4 illustrates the characteristics of electricity charged on the photoconductor 3. In more particular, FIG. 4 shows the relationship between the voltages applied to the charge roller 41 and the charged potential of the photoconductor 3 which is charged upon application of the voltages to the charge roller 41. In FIG. 4, reference symbols L3, L4 and L5 denote the relationship between the voltages and the potentials under the respective conditions (temperature/humidity) of 10[°C.]/20[%], 25[°C.]/50[%], and 32.5[°C.]/80[%].

As seen from FIG. 4, the higher the temperature, the more leftward the line representing the relationship.

As shown in FIG. 3, the output voltage of the conventional power source circuit is −1450[V], regardless of the environmental change. Therefore, the charged potential of the photoconductor 3 varies in a range between −818 and −878[V], as shown in FIG. 4, when the conditional change occurs in a range from 10[°C.]/20[%] to 32.5[°C.]/80[%]. That is, the potential change by 60[V].

The output voltages of the power source circuit 42 of this embodiment are, as shown in FIG. 3. −1460[V], −1450[V], −1400[V], in accordance with the environmental changes. Thus, the charged potentials of the photoconductor 3 are, as shown in FIG. 4, −830[V], −852[V], and −830[V], under the conditions of 10[°C.]/20[%] 25[°C.]/50[%] and 32.5[°C.]/80[%], respectively. Thus, the potential varies by 22[V] in accordance with the environmental change, which means the variation in the power source circuit of this embodiment occurs in a smaller range than the case of the conventional power source circuit.

Figure 5:
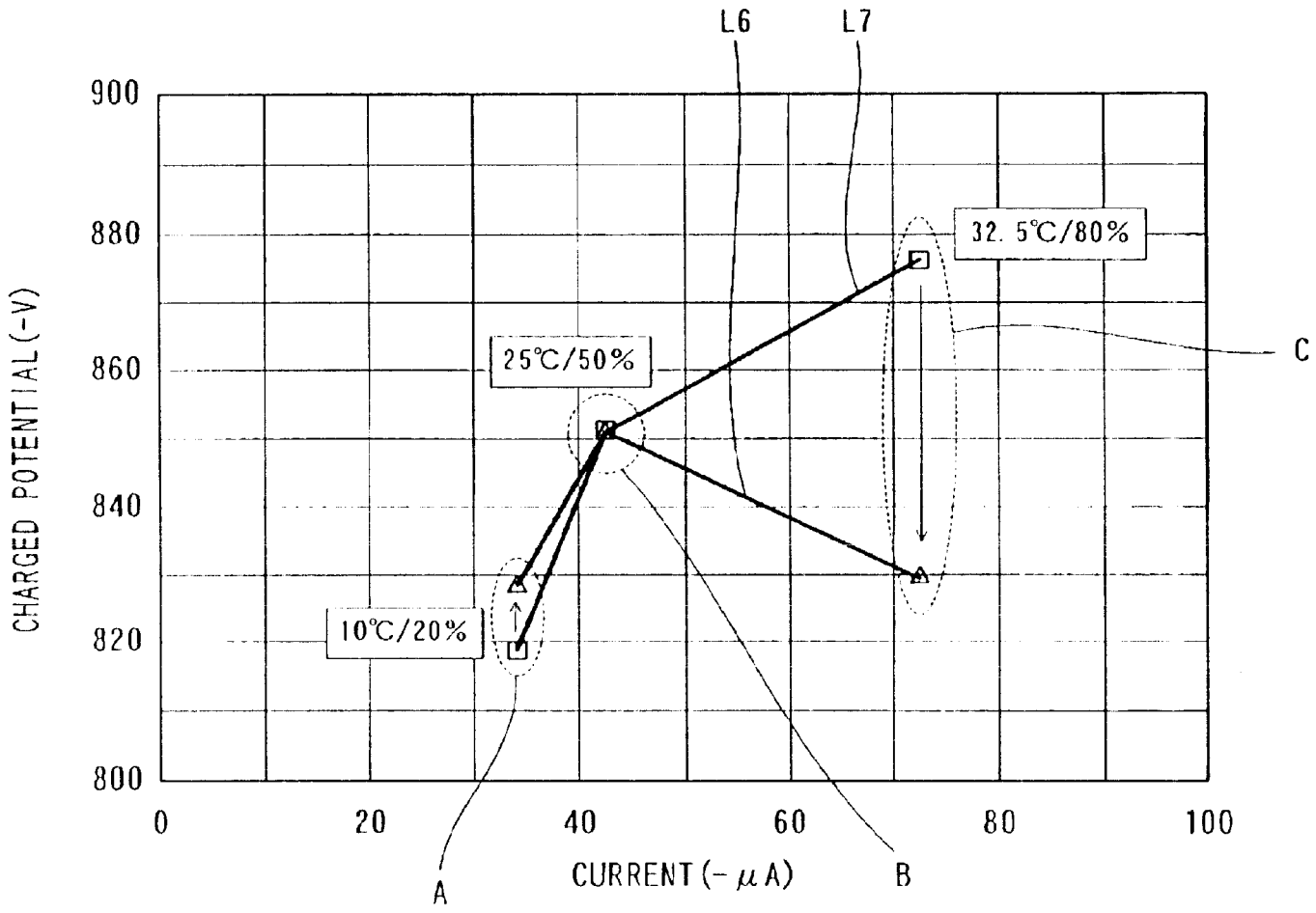
FIG. 5 is diagram showing the relationship between the charged potentials of the photoconductor and currents flowing to the charge roller.

FIG. 5 shows the relationship between the current flowing to the charge roller 41 and the charged potential of the photoconductor 3, in both case of the power source circuit 42 of this embodiment and the conventional power source circuit.

In FIG. 5, the characteristic line L6 indicates the voltage characteristics in the case of the power source circuit 42 of this embodiment, while the characteristic line L7 indicates the voltage characteristics in the case of the conventional power source circuit. Likewise in FIG. 3, reference symbols A, B, and C denote the results of measurement performed under the conditions (temperature/humidity) of 10[°C.]/20[%], 25[°C.]/50[%], and 32.5[°C.]/80[%] in FIG. 5.

As shown in FIG. 5, in the case where the conventional power source circuit is employed when the current flowing to the charge roller 41 increases, the charged potential of the photoconductor 3 increases. On the other hand, when the current flowing to the charge roller 41 decreases, the charged potential of the photoconductor 3 decreases.

On the contrary, when employing the power source circuit 42 of this embodiment, even if the current flowing to the charge roller 41 increases, an increase in the charged potential of the photoconductor 3 can be prevented. Additionally, even if the current flowing to the charge roller 41 decreases, the decrease in the charged potential of the photoconductor 3 can be prevented. Accordingly, having employed the power source circuit 42 of this embodiment, the variation in the charged potential of the photoconductor 3, as caused by any environmental change, can be prevented.

As obvious from the measurement results of FIGS. 3 to 5, having employed the power source circuit 42 including the resistor 42B, the charged potential of the photoconductor 3 can stably be maintained regardless of the environmental change.

In addition to the above-described environmental change, it is also known that the DC current flowing to the charge roller 41 tends to increase as a result of the abrasion of the photoconductor 3 (particularly, an optical conductive layer of the photoconductor 3), along with an increase in the number of to-be-printed papers.

The power source circuit 42, as shown in FIG. 3, has the characteristics that the output voltage decreases, where the current flowing to the charge roller 41 increases. Thus, even if the current flowing to the charge roller 41 increases, as caused by the abrasion of the photoconductor 3, an increase in the charged potential of the photoconductor 3 can be prevented. That is, even if the photoconductor 3 is abraded, the charged potential of the photoconductor 3 can stably be maintained.

Accordingly, in the structure where the power source circuit 42 includes the resistor 42B connected in series between the rectification circuit 42A and the charge roller 41, the charged potential of the photoconductor 3 can be stable.

The structure of the transfer device 7 will now specifically be described.

Figure 6:
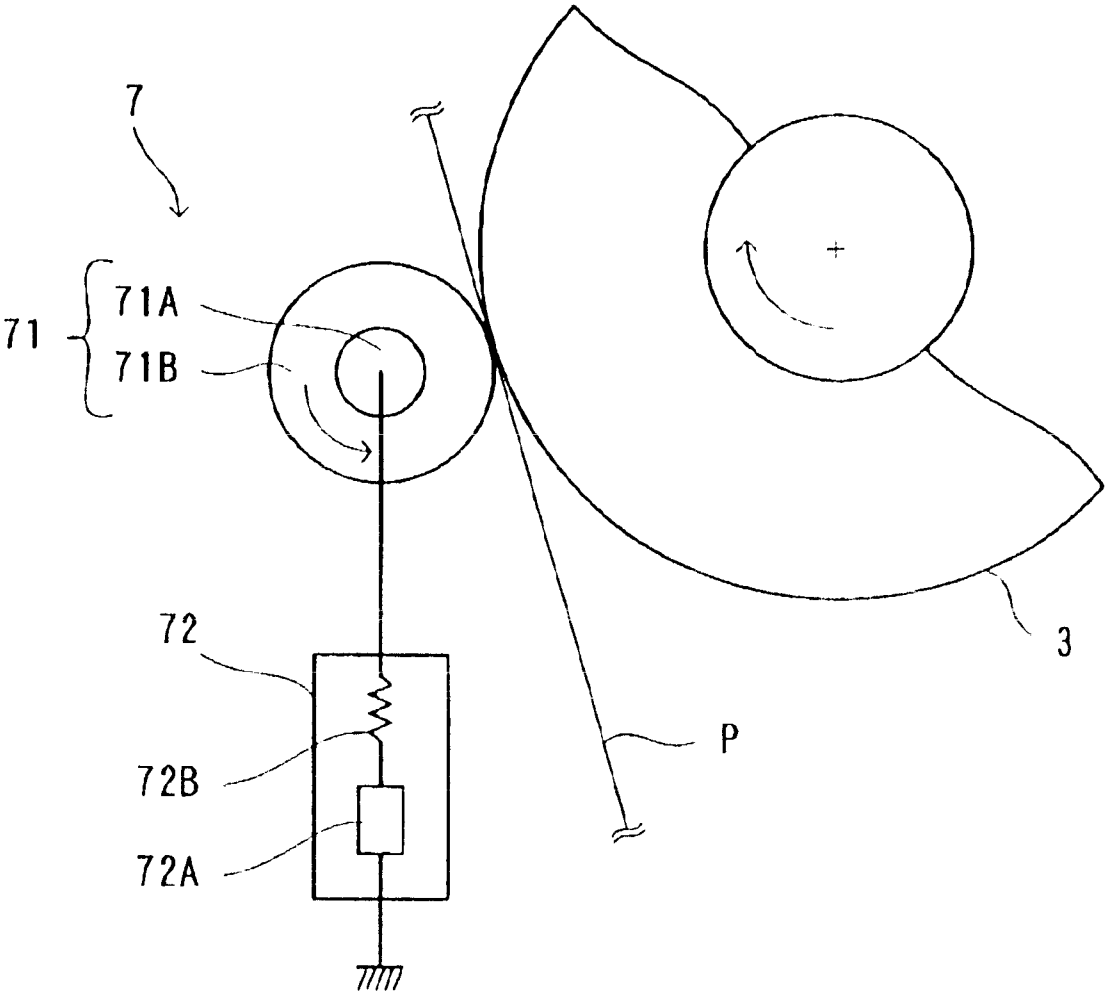
FIG. 6 is a diagram showing the structure of a copier included in the electronic photographic printer of FIG. 1.

The transfer device 7 comprises a transfer roller 71 and a power source circuit 72, as shown in FIG. 6.

The transfer roller 71 comprises a metal shaft 71A and a conductive layer 71B which is formed around the metal shaft 71A. Both ends of the metal shaft 71A are rotatively supported by non-illustrative shaft receivers. The conductive layer 71B is in contact with the photoconductor 3 so that a paper P is sandwiched therebetween. The conductive layer 71B rotates in accordance with the rotation of the photoconductor 3.

The power source circuit 72 applies a DC voltage to the transfer roller 71, thereby the transfer roller 71 is electrically charged as to have a polarity which is opposite to the polarity of the toner on the photoconductor 3. Then, the power source circuit 72 transfers a toner image which is formed on the photoconductor 3 onto the paper P. The power source circuit 72 comprises a rectification circuit 72A having a transformer or a bridge circuit, and a resistor 72B arranged between the rectification circuit 72A and the transfer roller 71. Another structure (such as a radiator, etc.) which is generally incorporated into the power source circuit 72 may be arranged between the rectification circuit 72A and the resistor 72B, or between the resistor 72B and the transfer roller 71.

The power source circuit 72 has the resistor 72B which is connected in series between the rectification circuit 72A and the transfer roller 71. Thus, the power source circuit 72 has substantially the same characteristics as that of the power source circuit 42.

Particularly, if the current flowing to the transfer roller 71 increases, the output voltage of the power source circuit 72 decreases. In addition, if the current flowing to the transfer roller 71 decreases, the output voltage of the power source circuit 72 increases.

The current flowing to the transfer roller 71 varies in accordance with the environment surrounding the transfer roller 71, such as the temperature, the humidity, etc., likewise the above. Hence, when employing a conventional power source device which does not include the resistor 72B, the toner image on the photoconductor 3 may not completely be transferred onto the paper P. For example, under the condition of 32.5[°C.]/80[%], the current flowing to the transfer roller 71 increases. At this time, if the voltage provided by the power source circuit does not decrease, a leakage current may occur. In this state, the toner image on the photoconductor 3 can not be transferred onto the paper P, otherwise the toner may be scattered around. Under the condition of 10[°C.]/20[%], the current flowing to the transfer roller 71 decreases. At this time, if the voltage provided by the power source circuit does not increase, an adequate level of the potential for transferring the toner image can not be obtained.

Because the power source circuit 71 has the resistor 72B, the voltage is low under the condition of, for example, 32.5[°C.]/80[%]. In addition, the leakage current or the scattering of the toner can not be prevented. Under the condition of, for example, 10[°C.]/20[%], the voltage is high. Thus, the adequate potential for transferring the toner image can be obtained. In this structure, the potential of the transfer roller 71 can be stable. As a result of the above, the toner image on the photoconductor 3 can desirably be transferred onto the paper P.

As explained above, in the structure where the power source circuit 42 includes the resistor 42B, the charged potential of the photoconductor 3 can stably be maintained. Similarly, in the structure where the power source circuit 72 includes the resistor 72B, the potential of the transfer roller 71 can be stable. Therefore, the printing can stably be achieved, regardless of the environmental change. In fact, when a dot image is printed using the electronic photographic printer 10 having the above-described power source circuit 42 and 72, no change is recognized in the dot size, as might have been caused by some kind of environmental change. Since, only the resistor 42B and 72B should additionally be included in the power source circuits 42 and 72, respectively, the power source circuits 42 and 72 of this embodiment can be realized at a low price.

Various embodiments and changes may be made thereonto without departing from the broad spirit and scope of the invention. The above-described embodiment intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2000-019851 filed on Jan. 28, 2000, and including specification, claims, drawings and summary. The disclosure of the above Japanese Patent Application is incorporated herein by reference in its entirety.

What is claimed is:

1. A charging device comprising:

a charge roller which is in contact with a photoconductor;

a power source circuit which applies a voltage to said charge roller, thereby to electrically charged the photoconductor as to have a predetermined potential;

wherein said power source circuit includes a resistor having a predetermined level of resistance, and provides said charge roller with a voltage through the resistor.

said power source circuit includes a rectification circuit which provides a predetermined level of a voltage; and the resistor is connected in series between the rectification circuit and said charge roller has a resistance in a range between 1 and 2 mega-ohms.

2. The charging device according to claim 1, wherein the resistance of the resistor is 1.5 mega-ohms.

3. The changing device according to claim 1, wherein said charge roller is formed of epichlorohydrine rubber containing an ionic conductive material.

* * * * *